US011371665B2

(12) United States Patent
Hou et al.

(10) Patent No.: US 11,371,665 B2
(45) Date of Patent: Jun. 28, 2022

(54) LIGHT DEVICE

(71) Applicant: XIAMEN ECO LIGHTING CO. LTD., Xiamen (CN)

(72) Inventors: Shoujiang Hou, Xiamen (CN); Yongzhe Dong, Xiamen (CN); Xiaoliang Wen, Xiamen (CN); Qiaorong Chen, Xiamen (CN); Caibin Li, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/559,732

(22) Filed: Sep. 4, 2019

(65) Prior Publication Data

US 2021/0062982 A1 Mar. 4, 2021

(51) Int. Cl.

| | |
|---|---|
| ***F21L 14/00*** | (2006.01) |
| ***F21V 21/002*** | (2006.01) |
| ***F21V 23/06*** | (2006.01) |
| ***F21V 3/02*** | (2006.01) |
| ***F21V 21/30*** | (2006.01) |
| ***F21V 17/16*** | (2006.01) |
| ***F21V 23/04*** | (2006.01) |
| ***F21S 8/00*** | (2006.01) |
| ***F21Y 113/17*** | (2016.01) |

(52) U.S. Cl.

CPC ..... *F21L 14/00* (2013.01); *F21S 8/035* (2013.01); *F21V 3/02* (2013.01); *F21V 17/164* (2013.01); *F21V 21/002* (2013.01); *F21V 21/30* (2013.01); *F21V 23/0428* (2013.01); *F21V 23/06* (2013.01); *F21Y 2113/17* (2016.08)

(58) Field of Classification Search

CPC ..... F21L 14/00; F21V 3/02; F21V 17/164; F21V 21/002; F21V 21/30; F21V 23/0428; F21V 23/06; F21Y 2113/17; F21S 8/035

See application file for complete search history.

(56) References Cited

U.S. PATENT DOCUMENTS

| | | | | |
|---|---|---|---|---|
| 6,709,126 | B1 * | 3/2004 | Leen | F21V 5/00 362/95 |
| 10,041,639 | B1 * | 8/2018 | Thompson | F21S 9/02 |
| 2002/0141177 | A1 * | 10/2002 | Stekelenburg | F21S 10/007 362/84 |
| 2003/0086266 | A1 * | 5/2003 | Leen | F21V 14/08 362/276 |

(Continued)

FOREIGN PATENT DOCUMENTS

| | | | | |
|---|---|---|---|---|
| JP | 2002373505 | A * | 12/2002 | F21V 23/0442 |

*Primary Examiner* — Erin Kryukova

(74) *Attorney, Agent, or Firm* — Chun-Ming Shih; Lanway IPR Services

(57) ABSTRACT

The light device includes a shell housing, a container located in the shell housing, and a light source assembly disposed inside the container. The light source assembly is configured to emit light of a first quality and a second quality different from the first quality. The light device also includes a plug disposed on the shell housing, and the plug is electrically connected to the light source assembly. A window is arranged on the shell housing for allowing light emitted from the light source assembly to pass through. A switch is disposed on the shell housing, and the switch is configured to enable the light source assembly to emit light of the first quality or the second quality.

18 Claims, 9 Drawing Sheets

(56) References Cited

U.S. PATENT DOCUMENTS

| | | | | |
|---|---|---|---|---|
| 2004/0090774 | A1* | 5/2004 | Hsueh | F21V 23/0442<br>362/183 |
| 2007/0109813 | A1* | 5/2007 | Copeland | H01R 35/04<br>362/641 |
| 2012/0099306 | A1* | 4/2012 | Balfour | F21S 8/035<br>362/231 |
| 2018/0309252 | A1* | 10/2018 | Xu | H01R 13/11 |
| 2020/0217465 | A1* | 7/2020 | Chien | F21S 9/022 |

* cited by examiner

LIGHT DEVICE

BACKGROUND OF THE INVENTION

Field of the Invention

The present invention is related to a light device, and more particularly related to a night light device with a smiling circular shape.

SUMMARY OF THE INVENTION

According to an embodiment, the light device includes a shell housing, a container located in the shell housing, and a light source assembly disposed inside the container. The light source assembly is configured to emit light of a first quality and a second quality different from the first quality. The light device also includes a plug disposed on the shell housing, and the plug is electrically connected to the light source assembly. A window is arranged on the shell housing for allowing light emitted from the light source assembly to pass through. A switch is disposed on the shell housing, and the switch is configured to enable the light source assembly to emit light of the first quality or the second quality.

The light source assembly further includes an adjustment device for adjusting the qualities of the light emitted by the light source assembly. For example, the light source assembly may be configured to emit light of a first luminance and a second luminance different from the first luminance. In another example, the light source assembly is configured to emit light of a first color temperature and a second color temperature different from the first color temperature.

The light device may further include a light passing shell disposed on the window. The light passing shell may include a diffuser.

According to the embodiment, the light source assembly includes a control circuit board, and a light source disposed on the control circuit board. The plug may be rotatable and disposed at a bottom of the bottom housing. The control circuit board has a circular shape.

The container may include a fixing column, and the control circuit board is fixed to the fixing column.

The shell housing may include a bottom housing and a face cover. The container is disposed on the bottom housing, and the face cover is disposed on an opening of the container. The window is disposed on the face cover. The bottom housing and the face cover form a circular shape with a circular cross section.

The face cover may include a convex surface and a concave surface. The convex surface and the concave surface are connected by a curve lateral wall. The convex surface, the concave surface, and the lateral wall form a smiling shape. The window is disposed on the lateral wall, and includes a curve shape.

The face cover and the bottom housing may be detachably connected with a clip structure. The clip structure includes a first clip located on the bottom housing and a second clip located on the face cover. The first clip is capable of connecting to the second clip for fixing the face cover onto the bottom housing.

The plug may include a plug base and metal pins disposed on the plug base. The plug base is connected to the bottom housing with a rotatable shaft.

DETAILED DESCRIPTION

Figure 1:
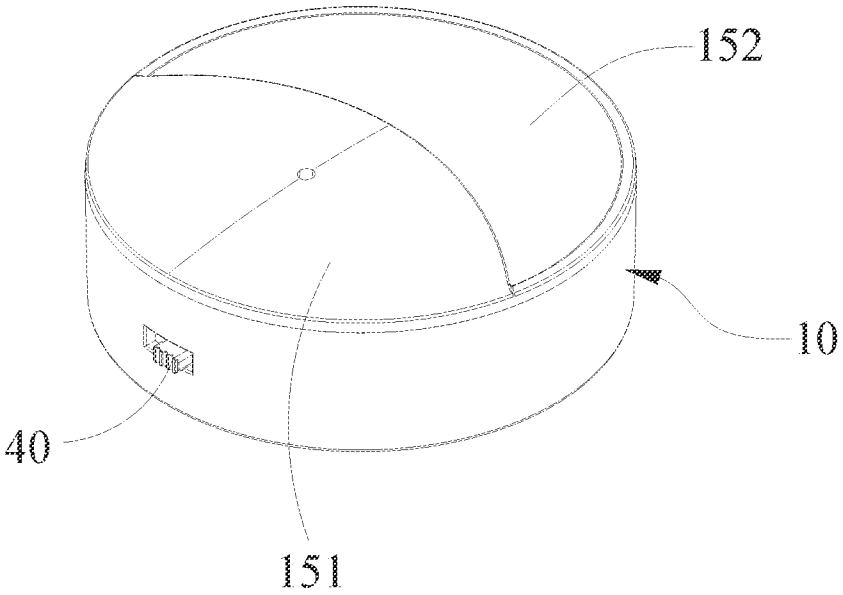
FIG. 1 is a structure diagram according to the first embodiment.
Figure 2:
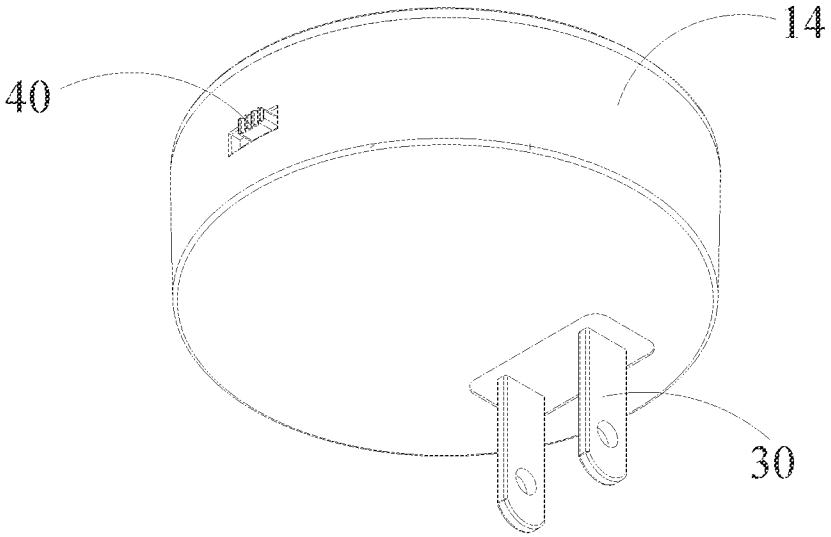
FIG. 2 is the structure diagram according to the first embodiment from another viewpoint.
Figure 3:
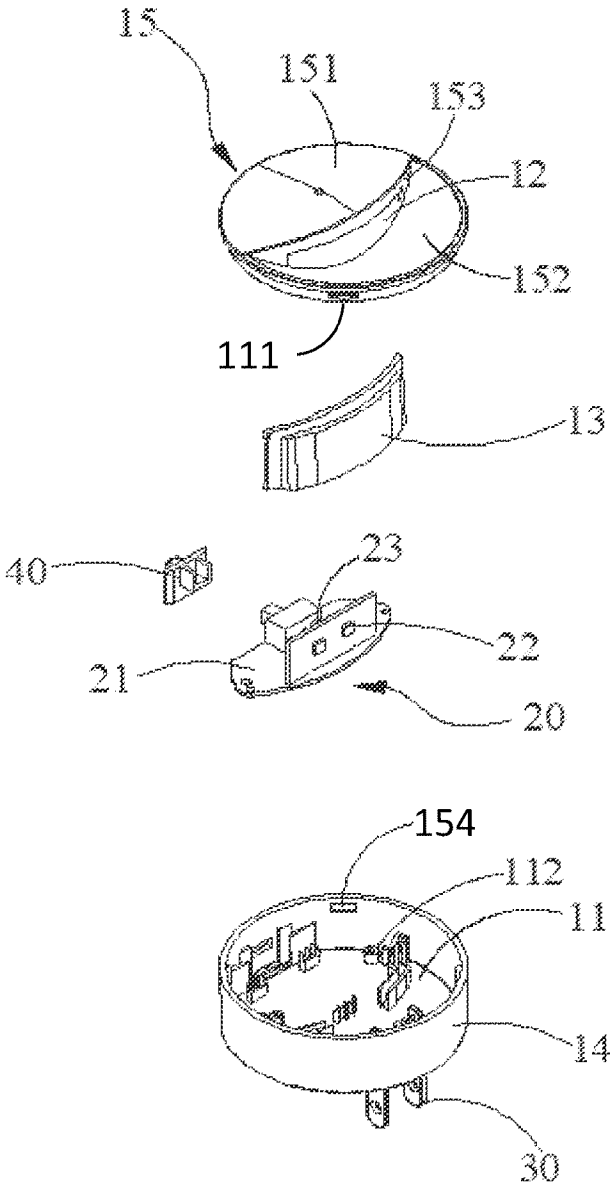
FIG. 3 is an exploded view of the first embodiment.

FIGS. 1 to 3 illustrates the first embodiment of the present invention. FIGS. 1 and 2 shows the appearance of the first embodiment from different viewpoints, and FIG. 3 shows the exploded view of the first embodiment. As shown in FIG. 1-3, the light device is a night light, which has a simple structure and small size, is easy to be assembled and carried by the user to anywhere, and has low production cost. The light device includes a shell housing 10, a container 11 located in the shell housing 10, and a light source assembly 20 disposed inside the container 11. The light source assembly 20 is configured to emit light of a first quality and a second quality different from the first quality. The light device also includes a plug 30 disposed on the shell housing 10, and the plug 30 is electrically connected to the light source assembly 20 for receiving external power and providing power to the light source assembly 20. A window 12 is arranged on the shell housing 10 for allowing light emitted from the light source assembly 20 to pass through to the outside of the shell housing 10 and illuminate the environment. A switch 40 is disposed on the shell housing 10, and the switch 40 is configured to enable the light source assembly 20 to emit light of the first quality or the second quality.

The light source assembly 20 further includes an adjustment device (not shown) for adjusting the qualities of the light emitted by the light source assembly 20. For example, the light source assembly 20 may be configured to emit light of a first luminance and a second luminance different from the first luminance. As an example, the first luminance is lower than 1 lux, and the second luminance is higher than 1 lux.

In another example, the light source assembly is configured to emit light of a first color temperature (e.g., 2,900K) and a second color temperature (e.g., 3,500K) different from the first color temperature. It is noted that both the first color temperature and the second color temperature are warm (i.e. yellowish), so the light source would not disturb the user from sleeping. As an example, the first color temperature is equal to or lower than 3,000K, which is preferred for enhancing sleeping environment.

The light device further includes a light passing shell 13 disposed on the window 12.

The light passing shell 13 may include a diffuser to diffuse the light emitted by the light source assembly 20.

In the first embodiment, the light source assembly 20 includes a control circuit board 21, and a light source 22 disposed on the control circuit board 21. The light source 22 includes a plurality of LED chips capable of emitting light of different color temperatures. For example, the light source 22 includes a first group of LED chips capable of emitting light of 2,900K, and a second group of LED chips capable of emitting light of 3,500K. When the switch 40 is moved to a first position, the first group of LED chips are enabled so the light source assembly 20 emits light of 2,900K; when the switch 40 is moved to a second position, the second group of LED chips are enabled so the light source assembly 20 emits light of 3,500K.

In another example, the light source 22 includes a plurality of LED chips capable of emitting light. When the switch 40 is moved to a first position, only some of the plurality of LED chips are enabled so the light source assembly 20 emits light of a first luminance; when the switch 40 is moved to a second position, all of the plurality of LED chips are enabled so the light source assembly 20 emits light of a second luminance different from the first luminance.

The container 11 includes a fixing column 112, and the control circuit board 21 is fixed to the fixing column 112.

The shell housing includes a bottom housing 14 and a face cover 15. The container 11 is disposed on the bottom housing 14, and the face cover 15 is disposed on an opening of the container 11. The window 12 is disposed on the face cover 15. The bottom housing 14 and the face cover 15 form a circular shape with a circular cross section appearing like a round face.

The face cover 15 includes a convex surface 151 and a concave surface 152. The convex surface 151 and the concave surface 152 are connected by a curve lateral wall 153. The convex surface 151, the concave surface 152, and the lateral wall 153 form a smiling shape. The lateral wall 153 appears like lips of the smiling face.

The window 12 is disposed on the lateral wall 153, and includes a curve shape providing a nice visual effect. The face cover 15 and the bottom housing 14 are detachably connected with a clip structure. The clip structure includes a first clip 154 located on the bottom housing 14 and a second clip 111 located on the face cover 15. The first clip 154 is capable of connecting to the second clip 111 for fixing the face cover 15 onto the bottom housing 14.

Figure 4:
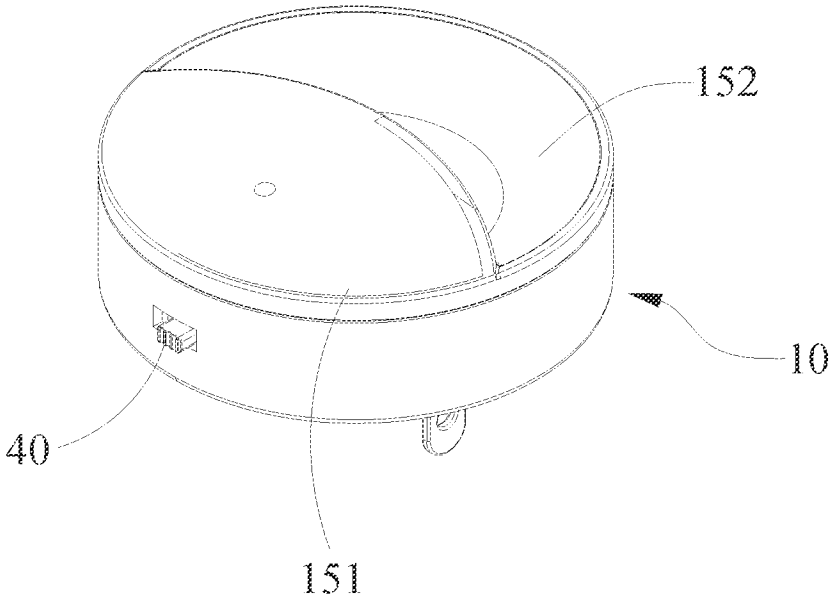
FIG. 4 is a structure diagram according to the second embodiment.
Figure 5:
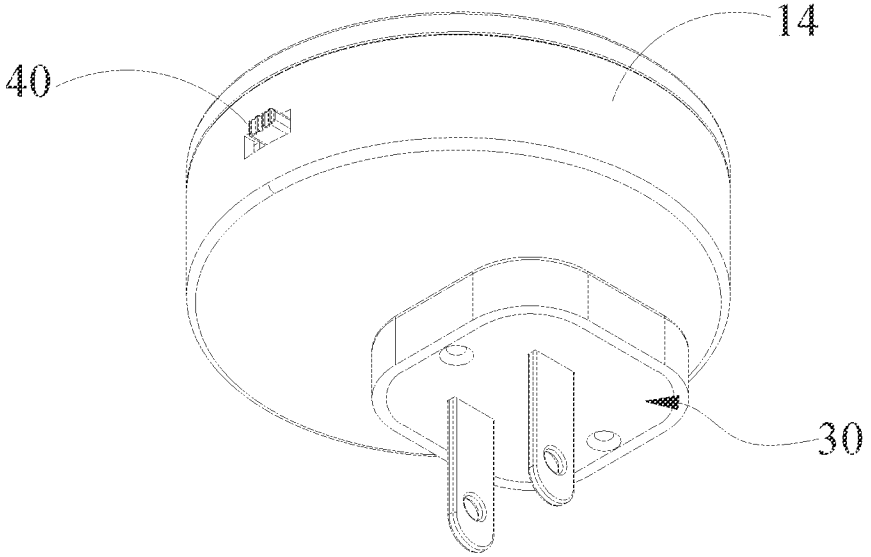
FIG. 5 is the structure diagram according to the second embodiment from another viewpoint.
Figure 6:
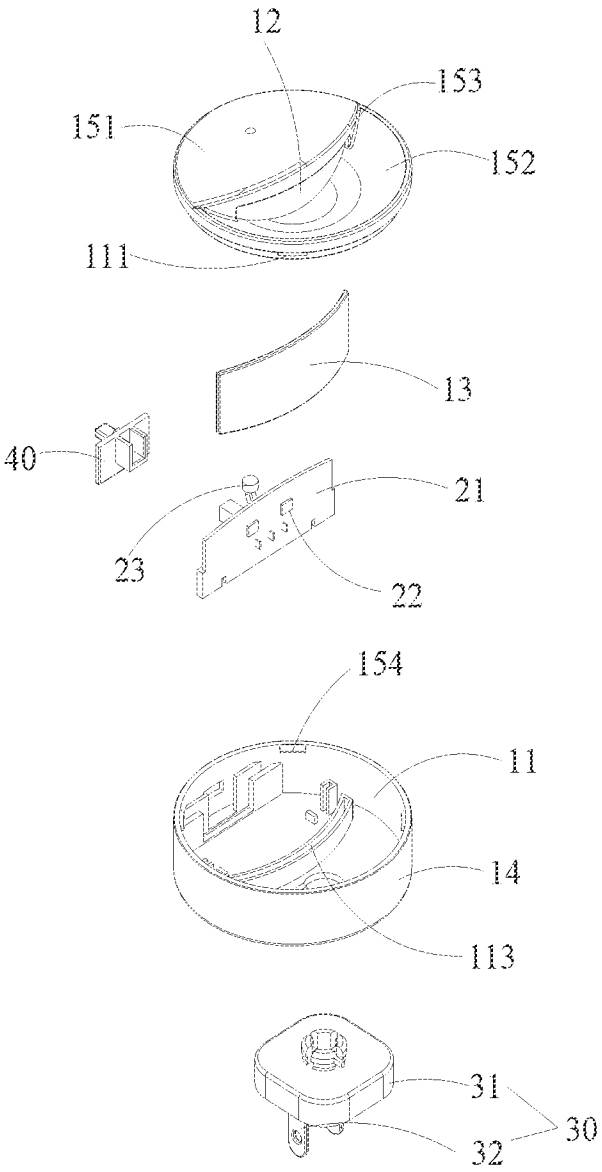
FIG. 6 is an exploded view of the second embodiment.

FIGS. 4 to 6 illustrates the second embodiment of the present invention. FIGS. 4 and 5 shows the appearance of the second embodiment from different viewpoints, and FIG. 6 shows the exploded view of the first embodiment. The second embodiment is similar to the first embodiment, except the plug 30 is rotatable and disposed at a bottom of the bottom housing 14. With such configuration, the light device of the second embodiment may be rotated to emit light to a desired direction. The plug 30 includes a plug base 31 and metal pins 32 disposed on the plug base 31. The plug base 31 is connected to the bottom of the bottom housing 14 with a rotation shaft. To provide moving space for the rotation shaft, the control circuit board 21 in this embodiment has a circular shape. There is a socket 113 disposed in the container 11 for plugging the control circuit board 21.

Figure 7:
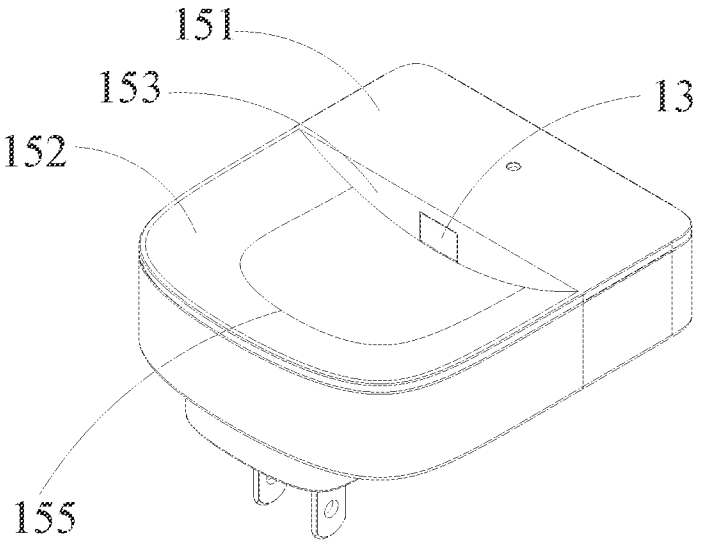
FIG. 7 is a structure diagram according to the third embodiment.
Figure 8:
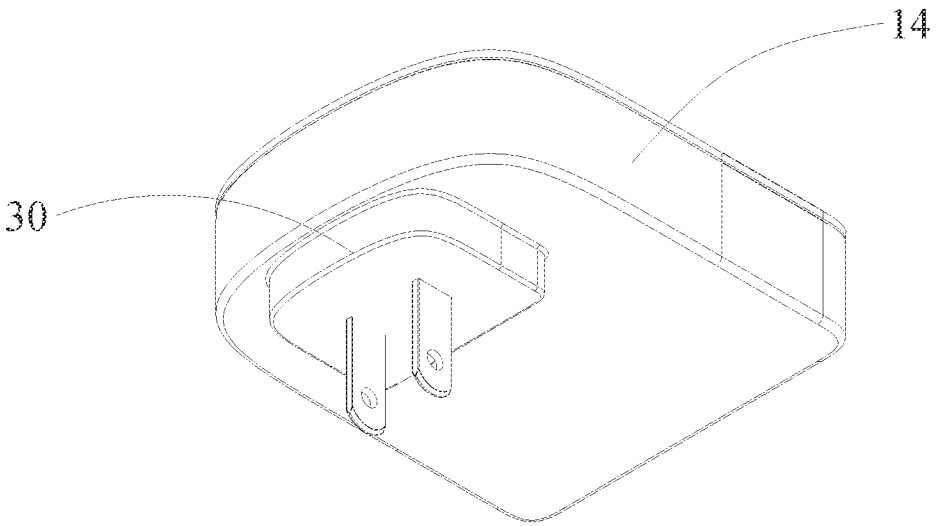
FIG. 8 is the structure diagram according to the third embodiment from another viewpoint.
Figure 9:
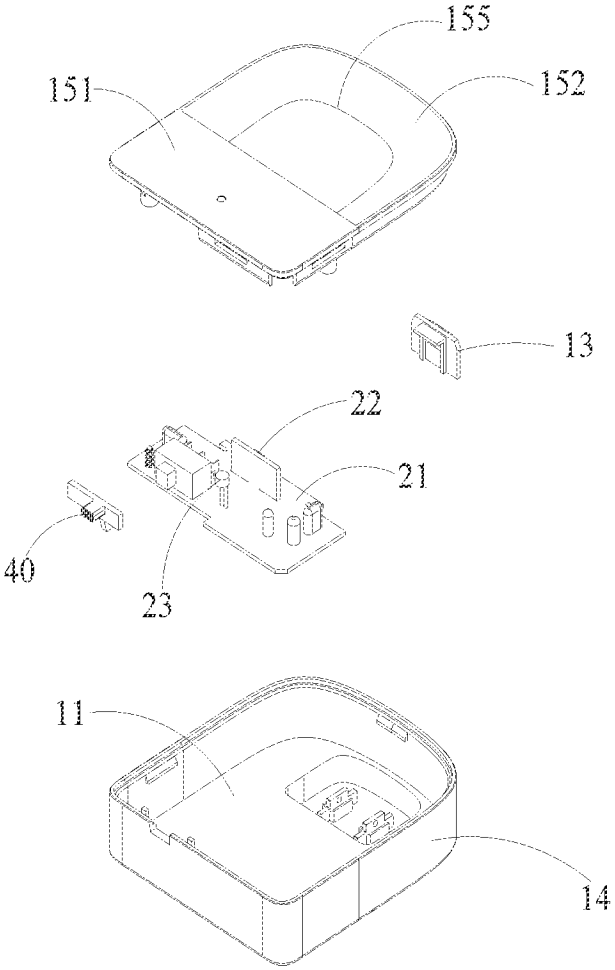
FIG. 9 is an exploded view of the third embodiment.

FIG. 7 to FIG. 9 illustrates a third embodiment of the present invention. FIGS. 7 and 8 show the appearance of the third embodiment from different viewpoints, and FIG. 9 shows the exploded view of the first embodiment. In the third embodiment, the bottom housing 14 is of rectangular shape with a round cross section structure. The lateral wall 153 between the convex surface 151 and the concave surface 152 is not curved, instead, the lateral wall 153 is flat. The window 12 is a bar shape, and the light passing shell 13 is also a bar shape. In addition, there is a border line 155 on the concave surface 152, which appears as a tongue shape while smiling.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

We claim:

1. A light device, comprising:

a shell housing;

a container located in the shell housing;

a light source assembly disposed inside the container, the light source assembly is configured to emit light of a first quality and a second quality different from the first quality;

a plug disposed on the shell housing and electrically connected to the light source assembly;

a window disposed on the shell housing for allowing light emitted from the light source assembly to pass through, and a switch disposed on the shell housing, the switch is configured to enable the light source assembly to emit light of the first quality or the second quality, wherein the shell housing includes a bottom housing and a face cover, the container is disposed on the bottom housing, and the face cover is disposed on an opening of the container, wherein the face cover includes a convex surface and a concave surface, wherein the convex surface and the concave surface are connected by a lateral wall, wherein the window is disposed on the lateral wall, wherein the light is projected on the concave surface after passing through the window.

2. The light device of claim 1, wherein the light source assembly adjusts the qualities of the light emitted by the light source assembly according to the switch.

3. The light device of claim 1, wherein the light source assembly is configured to emit light of a first luminance and a second luminance different from the first luminance.

4. The light device of claim 1, wherein the light source assembly is configured to emit light of a first color temperature and a second color temperature different from the first color temperature.

5. The light device of claim 1, wherein the light device further comprises a light passing shell disposed on the window.

6. The light device of claim 5, wherein the light passing shell includes a diffuser.

7. The light device of claim 1, wherein the light source assembly comprises a control circuit board, and a light source disposed on the control circuit board.

8. The light device of claim 7, wherein the plug is rotatable and disposed at a bottom of the bottom housing.

9. The light device of claim 8, wherein the control circuit board has a circular shape.

10. The light device of claim 7, wherein the container comprises a fixing column, and the control circuit board is fixed to the fixing column.

11. The light device of claim 1, wherein the window is disposed on the face cover.

12. The light device of claim 1, wherein the bottom housing and the face cover form a circular shape with a circular cross section.

13. The light device of claim 1, wherein the convex surface, the concave surface, and the lateral wall form a smiling shape.

14. The light device of claim 1, wherein the window includes a curve shape.

15. The light device of claim 1, wherein the face cover and the bottom housing are detachably connected with a clip structure.

16. The light device of claim 15, wherein the clip structure includes a first clip located on the bottom housing and a second clip located on the face cover, and the first clip is capable of connecting to the second clip for fixing the face cover onto the bottom housing.

17. The light device of claim 1, wherein the plug includes a plug base and metal pins disposed on the plug base.

18. The light device of claim 17, wherein the plug base is connected to the bottom of the bottom housing with a rotatable shaft.

* * * * *